United States Patent [19]

Takeda et al.

[11] Patent Number: 5,019,871

[45] Date of Patent: May 28, 1991

[54] APPARATUS FOR ELECTROSTATICALLY ABSORBING AN IMAGE SUPPORTING MATERIAL ON AN IMAGE SUPPORTING CARRYING MEMBER BASED ON THE KIND OF MATERIAL USED

[75] Inventors: Atsushi Takeda, Kawasaki; Takashi Hasegawa, Matsudo, both of Japan

[73] Assignee: Canon Kabushiki Kaisha, Tokyo, Japan

[21] Appl. No.: 568,550

[22] Filed: Aug. 16, 1990

Related U.S. Application Data

[63] Continuation of Ser. No. 448,212, Dec. 8, 1989, abandoned.

[30] Foreign Application Priority Data

Dec. 9, 1988 [JP] Japan ..... 63-310090

[51] Int. Cl.[5] ..... G03G 21/00

[52] U.S. Cl. ..... 355/309; 226/94; 271/193; 355/311

[58] Field of Search ..... 271/193; 226/93, 94; 355/208, 271, 273, 274, 308, 309, 311, 312

[56] References Cited

U.S. PATENT DOCUMENTS

| | | | |
|---|---|---|---|
| 3,584,733 | 6/1971 | Isermann | 226/94 X |
| 3,642,362 | 2/1972 | Mueller | 355/309 |
| 3,726,520 | 4/1973 | Doj | 355/309 X |
| 3,966,199 | 6/1976 | Silverberg | 226/94 X |
| 3,976,370 | 8/1976 | Goel et al. | 355/309 X |
| 3,981,498 | 9/1976 | Fletcher | 355/309 X |
| 4,674,860 | 6/1987 | Tokunaga et al. | 355/274 |

FOREIGN PATENT DOCUMENTS

| | | | |
|---|---|---|---|
| 2558615 | 12/1975 | Fed. Rep. of Germany . | |
| 54-96046 | 7/1979 | Japan . | |
| 55-32079 | 3/1980 | Japan . | |
| 55-110279 | 8/1980 | Japan . | |
| 57-64270 | 4/1982 | Japan . | |
| 58-25677 | 2/1983 | Japan . | |
| 61-28961 | 2/1986 | Japan . | |
| 0099170 | 5/1986 | Japan | 355/274 |
| 62-209558 | 9/1987 | Japan . | |
| 62-215979 | 9/1987 | Japan . | |
| 0244860 | 10/1987 | Japan | 226/93 |

OTHER PUBLICATIONS

Copy of European Search Report.

*Primary Examiner*—A. T. Grimley
*Assistant Examiner*—William J. Royer
*Attorney, Agent, or Firm*—Fitzpatrick, Cella, Harper & Scinto

[57] ABSTRACT

An image forming apparatus includes a movable image carrying member, a latent imager for forming a latent image on the image carrying member, a developer for developing the latent image by a toner, a transferrer for transferring a toner image on the image carrying member formed by the developer to an image supporting member at a transfer position, a carrier for carrying the image supporting member and for conveying the image supporting member to the transfer position in order to perform the transfer, and an adsorption device for causing the image supporting member to be electrostatically adsorbed onto the carrier by supplying the image supporting member with electric charges, a detector for detecting a kind of an image supporting member to be adsorbed, and a controller for controlling an electric-charge supply amount by the adsorption device according to the kind of image supporting member detected by the detector.

38 Claims, 8 Drawing Sheets

APPARATUS FOR ELECTROSTATICALLY ABSORBING AN IMAGE SUPPORTING MATERIAL ON AN IMAGE SUPPORTING CARRYING MEMBER BASED ON THE KIND OF MATERIAL USED

This application is a continuation of application Ser. No. 448,212 filed Dec. 8, 1989, now abandoned.

BACKGROUND OF THE INVENTION

1. Field of the Invention

This invention relates to an image forming apparatus, such as an electrophotographic apparatus, an electrostatic recording apparatus or the like, and more particularly, to an image forming apparatus having carrying means for carrying an image supporting member, such as paper or the like, and for conveying the image supporting member to an image forming position.

2. Description of the Related Art

In a color electrophotographic copier, a transfer drum is configured by winding a carrying member, generally in the form of a carrying sheet such as a high-resistance film, around a drum-like frame. A transfer material of receiving an image is supplied to the transfer drum and wound therearound, and an end of the transfer material is mechanically fixed and held by a gripper disposed at a part of the circumferential surface of the transfer drum. In this way, an image supporting member (the transfer material) is carried by carrying means (the transfer drum).

In the process of rotating the transfer drum a plurality of times, a toner image having plural colors is electrostatically transferred from an image carrying member (such as a photosensitive drum) to the surface of the transfer material. For this purpose, a corona charging device is disposed behind the carrying sheet at the transfer position, or a conductive roller is disposed in rotatable contact with the transfer material held on the carrying sheet, and electric charges having a polarity opposite to that of the toner image are supplied to the transfer material. Subsequently, in order to discharge the transfer material from the carrying sheet, the electrostatic adsorption force (Coulomb force) produced between the transfer material and the carrying sheet is weakened using a corona discharger, and a separation claw is inserted between the transfer material and the carrying sheet to separate the transfer material.

In the transfer drum provided with the mechanical gripper, however, there are several disadvantages, For example, when the carrying sheet is formed in the shaped of a drum, the gripper portion distorts the drum causing imperfect cleaning of the carrying sheet. Further, the image, forming region is narrowed by the width of the gripper portion to produce an image-free area where an image cannot be formed.

Furthermore, when the transfer drum provided with the gripper is used, the position of the gripper on the transfer drum is fixed, even if both A3- and A4-format paper can be used as the transfer material carried by the transfer drum and the transfer drum has a circumferential length corresponding approximately to A3 format. Hence, when A4-format paper is carried on the transfer drum, a portion in which the transfer material is not carried on the transfer drum exists as much as about half the circumferential length. As a result, the image forming speed is reduced by that amount, causing an inefficient operation.

There has therefore been proposed a method of holding a transfer material (refer to Japanese Patent Public Disclosure (Kokai) Publication No. 55-32079 (1980)), in which a corona charger is provided facing the surface opposite to the transfer-material holding surface of the carrying sheet, and a conductive roller is also provided facing the transfer-material holding surface, to electrostatically adsorb (or adhere) and hold the transfer material relative to the carrying sheet.

In the above-described method of holding a transfer material, since the transfer material is electrostatically held relative to the carrying sheet, a mechanical configuration, such as a gripper and the like, becomes unnecessary. Thus, there is no hindrance for cleaning the surface of the carrying sheet, and problems, such as image-free areas and the like, can be avoided. The image forming speed can also be increased.

In the method of electrostatically adsorbing the transfer material on the transfer drum without using a gripper, when a toner image is transferred from the image carrying member onto the transfer material, there is an influence of the charged amount which has been given in order to absorb and hold the transfer material on the carrying sheet. The charged amount of the transfer material changes due to differences in relative dielectric constant according to the kind of the material. When the charged amount is small, adsorption and holding force on the carrying sheet is insufficient to cause a deviation in position, particularly, a deviation in position during transfer process. When the charged amount is large, transfer efficiency is reduced, causing the generation of an inferior transfer.

Furthermore, in the method of adsorbing and holding the transfer material on the transfer drum without using a gripper, when different kinds of transfer materials having different stiffness are used, the force with which the transfer drum adsorbs and holds the transfer material becomes weaker as the stiffness is larger, causing a deviation in position. The transfer drum can more easily adsorb and hold the transfer material as the stiffness of the transfer material is smaller. If the adsorption and holding force is increased too much, however, it becomes occasionally difficult to separate the transfer material from the transfer drum after image formation on the transfer material has been completed.

SUMMARY OF THE INVENTION

The present invention has been made in consideration of the above-described problems.

It is an object of the present invention to provide an image forming apparatus in which failure in adsorption of an image supporting member on image-supporting-member carrying means is prevented.

It is another object of the present invention to provide an image forming apparatus for forming an excellent image without having deviation in image on an image supporting member by preventing the above-described failure in adsorption.

It is still another object of the present invention to provide an image forming apparatus for adsorbing an image supporting member onto carrying means irrespective of the kind of the image supporting member in such a manner that an excellent image may be formed.

In one aspect of the invention, there is provided an image forming apparatus including a movable image carrying member, latent image forming means for forming a latent image on the image carrying member, developing means for developing the latent image by a toner, transfer means for transferring a toner image of the image carrying member formed by developing means to an image supporting member at a transfer station, carrying means for carrying the image supporting member and for conveying the image supporting member to the transfer position, adsorption means for causing the image supporting member to be adsorbed onto the carrying means, detection means for detecting a charateristic of an image supporting member to be absorbed, and control means for controlling adsorption means in accordance with the characteristic of the image supporting member detected by the detecting means.

DETAILED DESCRIPTION OF THE PREFERRED EMBODIMENTS

The preferred embodiments of the present invention will hereinafter be explained with reference to the drawings.

Figure 1:
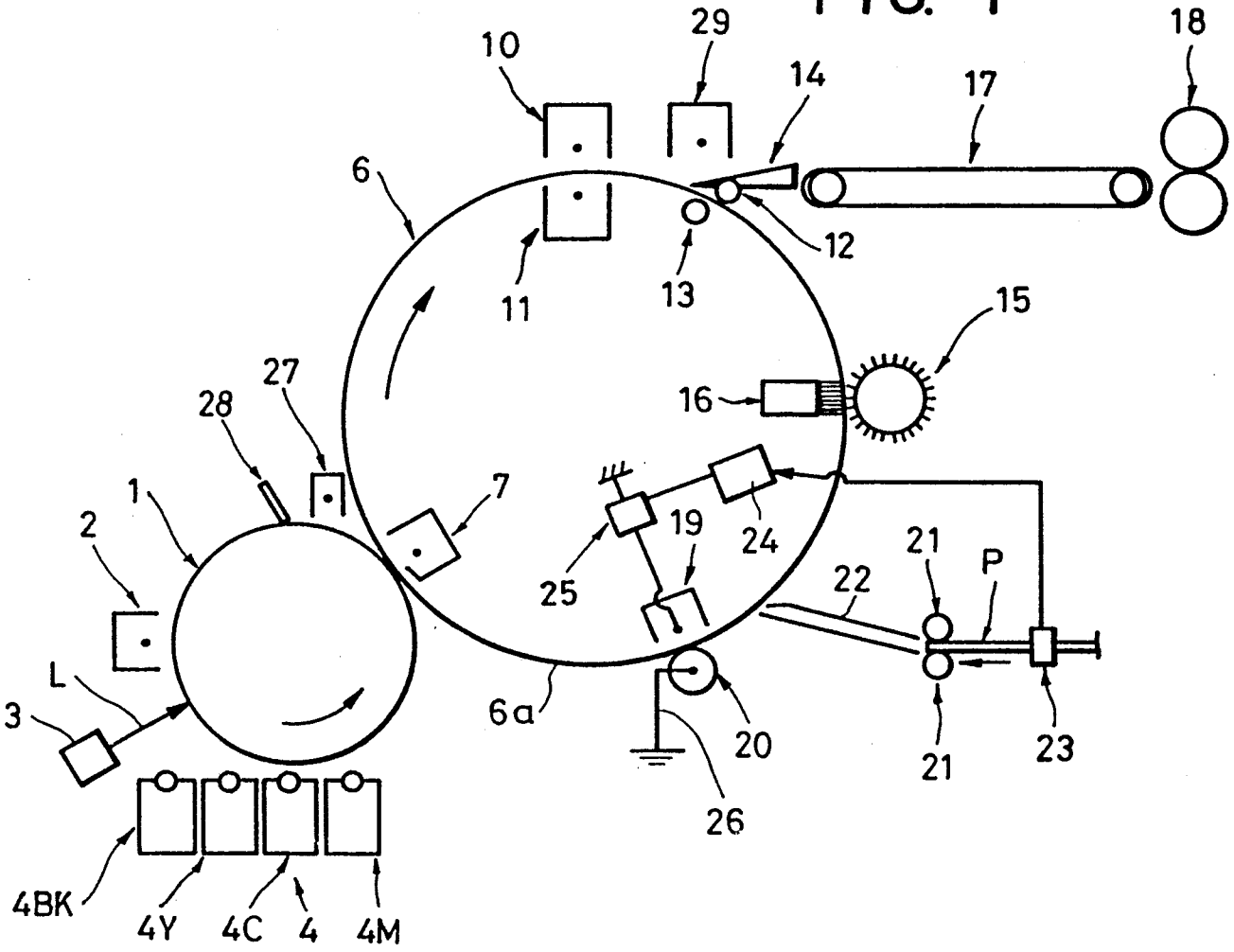
FIG. 1 is a schematic diagram showing an embodiment of the image forming apparatus of the present invention.

In FIG. 1, a photosensitive drum 1 as an image carrying member is rotatably supported at the center of the drum, and is rottatably driven in the direction of the arrow. Facing the outer circumferential surface of the photosentive drum 1, a primary charger 2, an optical system 3 and a developer supplier 4 are disposed in the direction of rotation of the drum 1. The primary charger 2 provides a uniform charged amount on the photosensitive drum 1. The optical system 3 provides an optical image subjected to color separation with a predetermined timing or a light beam L corresponding thereto on the surface of the photosentive drum 1 to form an electrostatic latent image. A laser-beam exposure apparatus or the like is used for the optical system 3. The developer supplier 4 is of movable type which faces the surface of the photosensitive drum 1 and moves in the tangential direction, and is provided with four developing devices 4M, 4C, 4Y and 4BK housing four-color developers, that is, magenta, cyan, yellow and black developers, respectively. The developer supplier 4 faces the developing device selected in accordance with the optical image of the color selected by the optical system 3 or the irradiation of the corresponding light beam L relative to the photosensitive drum 1, and electrostatically provides toner to develop a toner image on the surface of the photosensitive drum 1.

A transfer drum 6 is situated in the direction of rotation of the photosensitive drum 1, in contact with or slightly apart from the surface of the photosensitive drum 1. On the transfer drum 6, a carrying sheet **6*a* consisting only of a dielectric sheet, such as polyvinylidene fluoride resin, is cylindrically wound between cylindrical end frames. A corona charger 7 for transfer is disposed at the side opposite to the holding surface of the carrying sheet 6*a* facing the photosensitive drum 1. The tansfer drum 6 is rotatably driven in the direction of the arrow. A corona charger 19 for adsorption is disposed at the side opposite to the holding surface at an upstream position in the direction of movement of the transfer drum 6 from the transfer position, and, in facing arrangement, a conductive roller 20 made of metal or the like is disposed facing the holding surface. Corona dischargers 10 and 11 for removing charges are disposed facing both surfaces of the carrying sheet 6*a* at a downstream position in the direction of movement of the transfer drum 6 from the transfer position. Pushing rollers 12 and 13 for separating a transfer material P (to be described later) from the carrying sheet 6*a* are also disposed facing both surfaces of the carrying sheet 6*a* are also disposed facing both surfaces of the carrying sheet 6*a*, and a claw 14 for separation is disposed nearby. At a further downstream position in the direction of movement of the transfer drum 6 relative to the claw 14 for separation, there is provided a brush roller 15 for cleaning the holding surface of the carrying sheet 6*a* and, if necessary, a corona discharger or brush-type charge remover 16** for removing adhesion force (residual Coulomb force or van der Waals force).

The transfer material P separated by the claw 14 for separation and carrying a toner image is supplied toward a fixing roller 18 via a conveyor 17, where the toner image is fixed.

At an immediately upstream position in the direction of movement of the transfer drum 6 from the corona charger 19 and the conductive roller 20, there is provided transfer-material supply means for supplying the transfer material P to the holding surface of the carrying sheet **6*a* by guiding it into a guide 22 via resist rollers 21, 21**.

Figure 8:
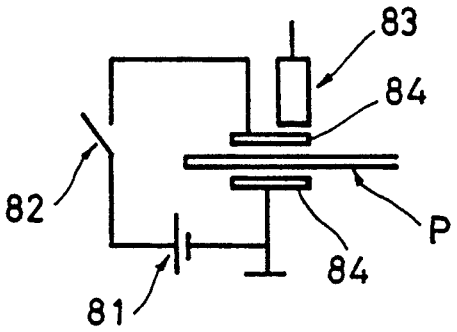
FIG. 8 is an explanatory diagram showing an embodiment of detection means for detecting the relative dielectric constant of a transfer material.

In the present embodiment, there is provided means 23 for detecting the relative dielectric constant of the transfer material P at the supply position of the transfer material P. In the detection means 23, as shown in FIG. 8, facing electrodes 84, 84 are connected to a power supply 81 as electric-charge supply means via a switch 82. The switch 82 is first closed to supply electric charges to the facing electrodes 84, 84 the switch 82 is then opened, the transfer material P is inserted between the facing electrodes 84, 84, and the potential at that time is measured by an electrometer 83. It is possible to measure differences in the relative dielectric constant of the transfer material P according to differences in the potential.

Referring back to FIG. 1, there is also provided control means 24, such as a central processing unit (CPU) and the like, for determining the electric-charge supply amount according to a signal from the above-described detection means 23. The control means 24 outputs a control signal to change the electric-charge supply amount from a transformer power supply 25 to the corona charger 19. As the central processing unit in the above-described embodiment, a unit utilized for other purposes in the image forming apparatus can of course be utilized. It is also to be noted that, in the above-described embodiment, the conductive roller 20 is grounded via a ground line 26.

In FIG. 1, a charge remover 27 removes static electric charges on the surface of the photosensitive drum 1, and a cleaning blade 28 removes the toner. If necessary, a corona discharger 29 may be provided near the claw 14 for separation for the purpose of preventing disturbance in image due to discharge at peeling caused when the transfer material P is separated from the carrying sheet 6a, to perform AC corona discharge.

In such a configuration, when a color image passing through, for example, a green filter is first irradiated on the surface of the photosensitive drum 1 by the optical system 3 in a state in which the surface of the photosensitive drum 1 is uniformly charged by the primary charger 2, a latent image to be developed by the magenta developer among color images is formed thereon. In synchronization with the feeding of the latent image, the developer supplied 4 moves the developing device 4M housing the magenta developer in the tangential direction to the photosensitive drum 1 to face it relative to the photosensitive drum 1, and electrostatically provides the toner to develop a magenta image on the photosensitive drum 1.

On the other hand, the transfer material P as the image supporting member for supporting the toner image is guided into the guide 22 with the function of the resist rollers 21, 22, and is further supplied to the position of the conductive roller 20 along the surface of the carrying sheet 6a. At the adsorption position where the corona charger 19 faces the conductive roller 20, the transfer material P is adsorbed and held on the carrying sheet 6a having curvature. Electrostatic adsorption is produced by the following process. A voltage (for example, positive) having polarity identical to that of the corona charger 7 for transfer is applied to the corona charger 19, positive charges are therefore supplied to the dielectric carrying sheet 6a, and current thereby flows through the grounded conductive roller 20 to induce negative charges in the transfer material P. Hence, the transfer material P is adsorbed onto the carrying sheet 6a caused by attraction between the positive charges in the carrying sheet 6a and the negative charges on the transfer material P.

The transfer material P is thus electrostatically adsorbed and held on the carrying sheet 6a, and is sent to the transfer position where the photosensitve drum 1 faces the corona charger 7 for transfer, that is, the image forming position of the transfer material P where a toner image is formed on the transfer material P. In this case, the feeding timing of the transfer material P by the resist rollers 21, 21 is in synchronization with the timing for forming the latent image by the optical system 3, and the both timings coincide with each other at the transfer position. At the transfer position, electric field for transfer is generated by the corona charger 7 for transfer to which a positive voltage is applied, and the toner on the photosensitive drum 1, which has been negatively charged by positive electric charges supplied to the carrying sheet 6a, is thereby held on the transfer material P.

The electric charges in the residual toner on the photosensitive drum 1 is removed by the charge remover 27. The residual toner is then removed by the blade 28, and the surface of the photosensitive drum 1 is cleaned. On the other hand, the tranfer material P adsorbed on the carrying sheet 6a is moved in accordance with the rotation of the transfer drum 6 while carrying the toner image, and passes through between the corona dischargers 10 and 11. At this moment, the corona discharges 10 and 11 are not energized, and the pushing rollers 12 and 13 are separated from the carrying sheet 6a. The brush roller 15, the corona discharger or brush-type charge remover 16 and the conductive roller 20 are also separated from the carrying sheer 6a. Accordingly, the transfer material P passes through between the corona charger 19 and the conductive roller 20 without disturbing the toner image on the transfer material P held by Coulomb force, and is sent again to the transfer position. Before the front end of the toner image on the transfer material P reaches the above-described position of the corona charger 19 and the conductive roller 20, the voltage applied to the corona charger 19 has been turned off, and the conductive roller 20 has been separated from the carrying sheet 6a. Hence, when the transfer material P passes through between the corona charger 19 and the conductive roller 20, electric charges for adsorbtion are not supplied. Furthermore, before the front end of the toner image on the transfer material P reaches the transfer position, image formation by the magenta developer has been completed, and the optical system 3 has already irradiated a color image passing through a red filter on the photosensitive drum 1. The developer supplier 4 faces the developing device 4C against the photosensitive drum 1 by shifting it, electrostatically provides the toner toward the latent image to develop a cyan image on the photosensitive drum 1. For this purpose, a toner image by the cyan developer is transferred overlapped with the preceding toner image by the magenta developer at the transfer position.

Thus, the optical system 3 irradiates optical images, which are abtained by performing color separation relative to an identical image a plurality of times while sequentially providing green, red and blue filters, on the photosensitive drum 1 to form latent images. The developer supplier 4 supplies the photosensitive drum 1 with corresponding developers, that is magenta, cyan and yellow developers to perform color development as a whole. The sequence of providing the filters and supplying the developers can of course be appropriately selected according to requirement.

After the final toner image, which is an image by the yellow developer in the present embodiment, has been transferred onto the transfer material P, the corona dischargers 10 and 11 are energized when the transfer material P passes through between them to remove the electric charges, and the pushing rollers 12 and 13 are pressed against the carrying sheet 6a to increase curvature at the pressed portion and to aid peeling of the transfer material P from the carrying sheet 6a. The claw 14 for separation contacts or comes close to the carrying sheet 6a to separate the front end of the transfer material P from the carrying sheet 6a and to supply the transfer material P to the fixing rollers 18 via the conveyor 17. The fixing rollers 18 then fix the toner image on the transfer material P. In separating the transfer material P, disturbance of the image due to discharge at peeling may be prevented by the corona discharger 29. The surface of the carrying sheet 6a after the separation of the transfer material P is cleaned by the brush 15. At this time, if the residual toner still continues to keep the electrostatic adhesion force, cleaning cannot be performed satisfactorily. The removal of the residual toner by the corona discharger or brush-type charge remover 16 provides an effective cleaning.

The reproduction of a color image can thus be performed. When the filters are not used in the optical system 3 and the developing device 4BK for the black developer is faced against the photosensitive drum 1 in the developer supplier 4, a normal black-and-white reproduction can be performed. In this case, since only one transfer is performed, there is provided the function of each component which corresponds to the case of the final development in color reproduction.

If necessary, in the final stage of color development, the exposure of white light and a black image by the black developer may be superposed.

Particularly in the present embodiment, when the transfer material P is supplied to the carrying sheet 6*a*, the charge supply amount at the corona charger 19 for adsorption is controlled according to differences in the relative dielectric constant of the transfer material P. For this purpose, the detection means 23 discriminately detects differences in the relative dielectric constant of the transfer material P, and provides the central processing unit 24 with the results.

It is desirable, however, to control the charge supply amount at the corona charger 19 for adsorption according to differences in the kind of the transfer material P which influences the adsorption force of the transfer material P relative to the carrying sheet 6*a*. The kind of the transfer material P takes into consideration the fact that the stiffness of the transfer material P differs as well as the above-described relative dielectric constant when the material of the transfer material P differs. The adsorption force of the transfer material P relative to the carrying sheet 6*a* also differs according to differences in the stiffness of the transfer material P. In this case, larger adsorption current may be supplied as the relative dielectric constant of the transfer material P is smaller or the stiffness is larger. Furthermore, since the electrostatic capacity of the transfer material P also changes, that is, the amount of electric charges supplied to the transfer material P changes according to the thickness of the transfer material P, the thickness of the transfer material P may also be taken into consideration in the kind of the transfer material P. In this case, larger adsorption current may be supplied as the thickness of the transfer material P is larger. Furthermore, since the weight of the transfer material P differs when the kind of the transfer material P differs, larger adsorption current may be supplied as the weight of the transfer material P is larger.

In order to detect differences in the kind of the transfer material P caused by several factors by the detection means 23, processing may have previously been preformed on the surface or the like of the transfer material P in which the optical transmittance or reflectivity of the transfer material P differs according to the kind of the transfer material P. The differences may be detected by optical means, such as a photodiode or the like.

The detection means 23 may comprise means for mechanically or electrically detecting the kind of the transfer material P from the set state of a dedicated cassette for separately housing the transfer material P according to its kind.

From the practical point of view, the detection means 23 may be configured so as to discriminate a sheet for overhead projection (OHP) or a sheet for a secondary translucent paper from other transfer material, for example, ordinary paper.

Thus, the central processing unit 24 outputs a control signal for changing the electric-charge supply amount from the transformer power supply 25 to the corona charger 19 according to the signal detected by the detection means 23.

Figure 2:
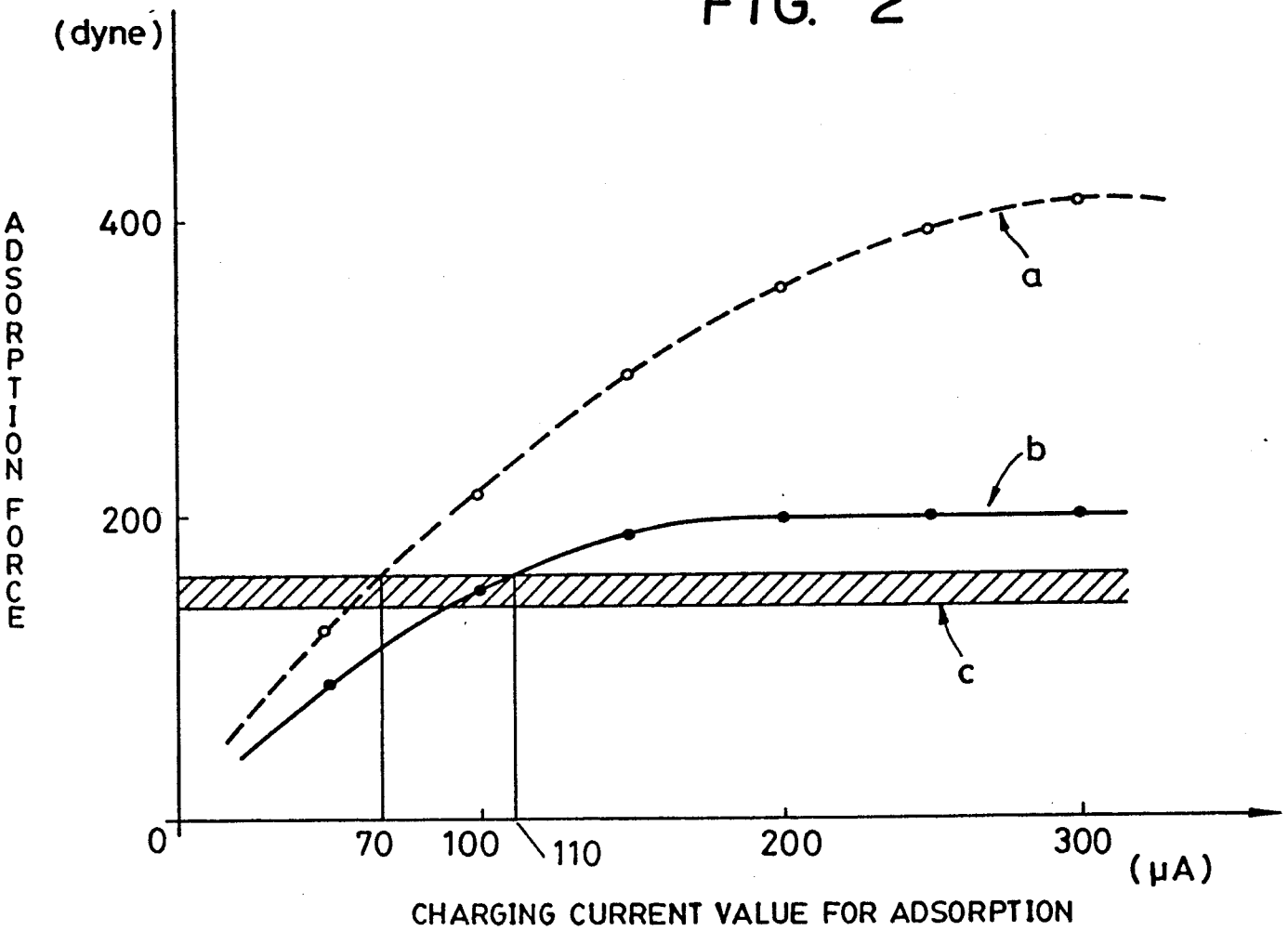
FIG. 2 is a graph showing a relationship between the charging current value for adsorption and the adsorption force.

FIG. 2 shows changes in the value of the adsorption force (Coulomb force) when the value of the corona charging current (the measured value obtained by providing an ammeter between the high-voltage output port of the transformer and the feeding port of the corona charger 19 for adsorption) of the corona charger 19 for adsorption is changed, for a sheet "a" for OHP ( the dotted line with points ) and ordinary paper "b" ($80g/m^2$) (the full line with points ). In this case, the charging current value of the corona charger 7 at the moment of tranfer is kept constant (for example, 150 $\mu$A). The adsorption force was measured at a portion where electric charges are not supplied to the transfer material P from the corona charger 7 for transfer, that is, between the position where the transfer material P is adsorbed onto the carrying sheet 6*a* and the position where it first receives corona current for transfer, and the values were read when the transfer material P started moving when the transfer material P having an area of $5\times10cm^2$ was pulled at one end thereof in the tangential direction of the carrying sheet 6*a* using a spring meter. The adsorption force may be measured anywhere provided that the function of the corona charger 7 for transfer is stopped.

In FIG. 2, the hatched region C indicates a threshold region where the transfer material P is nearly stably adsorbed on the carrying sheet 6*a* and deviation is not produced from a practical point of view.

As is apparent from FIG. 2, when the charging current value for adsorption is constant, the adsorption force is larger for the sheet for OHP. It is considered that this is due to differences in Coulomb force because the relative dielectric constant of the sheet of OHP (for example, PET (polyethylene terephthalate)) is larger than that of ordinary paper, that is, the sheet for OHP has larger charge retention capability. The larger adsorption force is also due to differences in adhesion force relative to the carrying sheet 6*a* because the sheet for OHP has smaller stiffness than ordinary paper. In order to provide a nearly stable adsorption, the current values for the sheet for OHP and ordinary paper must be not less than 70 $\mu$A and 110 $\mu$A, respectively.

Figure 3:
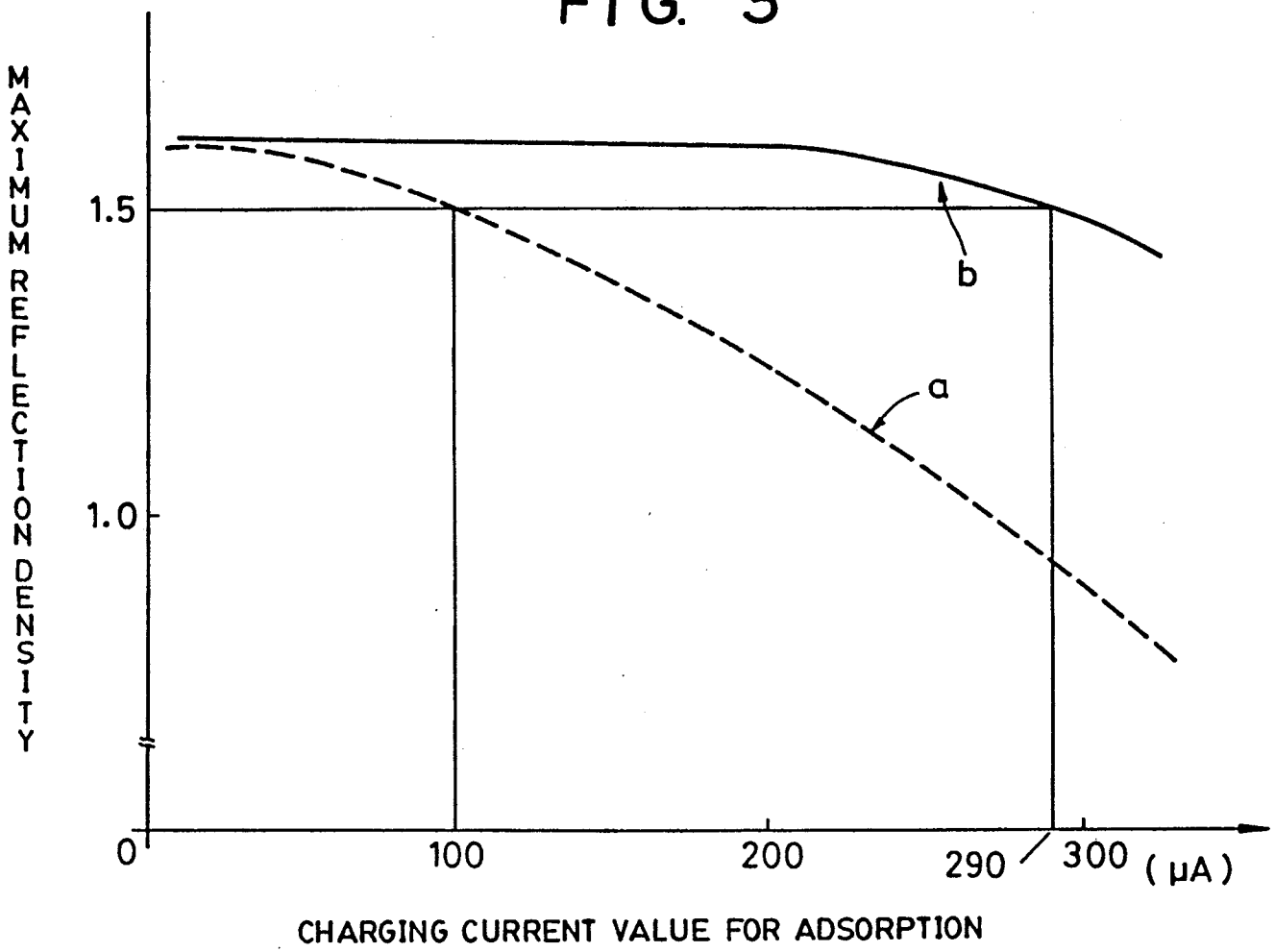
FIG. 3 is a graph showing a relationship between the above-described charging current value and the maximum reflection density.

On the other hand, FIG. 3 shows a relationship between the charging current value for adsorption shown in FIG. 2 and the maximum reflection density at transfer. The maximum reflection density indicates reflection density on the transfer material P on which a toner image is formed, after the toner image, which has the maximum reflection density relative to the surface of the photosensitive body after development, has been transferred. The reflection density can be measured by irradiating a light beam on a surface the reflection density of which is to be measured and detecting the light beam reflected from the surface. The reflection density is of course larger as the reflected light beam is smaller. Accordingly, transfer efficiency is larger as the above-described reflection density is larger. FIG. 3 indicates that the maximum reflection density, that is, transfer efficiency decreases as the charging current value for adsorption is increased. This fact indicates that by increasing the charging current value for adsorption, electric charges for adsorption having a polarity identical to that of electric charges for transfer relative to the carrying sheet 6a increase, as well as the injection amount of electric charges having a polarity identical to that of the toner (a polarity opposite to that of the electric charges for transfer) increases, and hence the electric field strength between the surface of the photosensitive drum 1 and the transfer material P decreases at the moment of transfer. Accordingly, since the sheet "a " for OHP (shown by the dotted line) has larger charge retention capability than ordinary paper "b" (shown by the full line), its maximum reflection density decreases rapidly. For example, the maximum reflection density is 1.5 or above when the sheet "a" for OHP and ordinary paper "b" have the charging current values for adsorption of 100 μA and 290 μA or less, respectively.

From the above-described results of measurement, in order that the transfer material P is stably adsorbed on the carrying sheet 6a and has the maximum reflection density of at least 1.5 (the range where transfer is excellently performed from a practical point of view), the charging current value for adsorption must be between 70 μA and 100 μA, inclusive, for the sheet "a" for OHP, and between 110 μA and 290 μA, inclusive, for ordinary paper "b". This range must of course be changed according to the charging current value of the corona charger 7 at the transfer position. In any case, however, the results indicate that the charge supply amount for the sheet for OHP and ordinary paper must be controlled. In the above-described example, the central processing unit 24 supplies the transformer power supply 25 with control signals so that the charging current values for adsorption are set to 80 μA and 200 μA for the sheet of OHP and ordinary paper, respectively.

Figure 4:
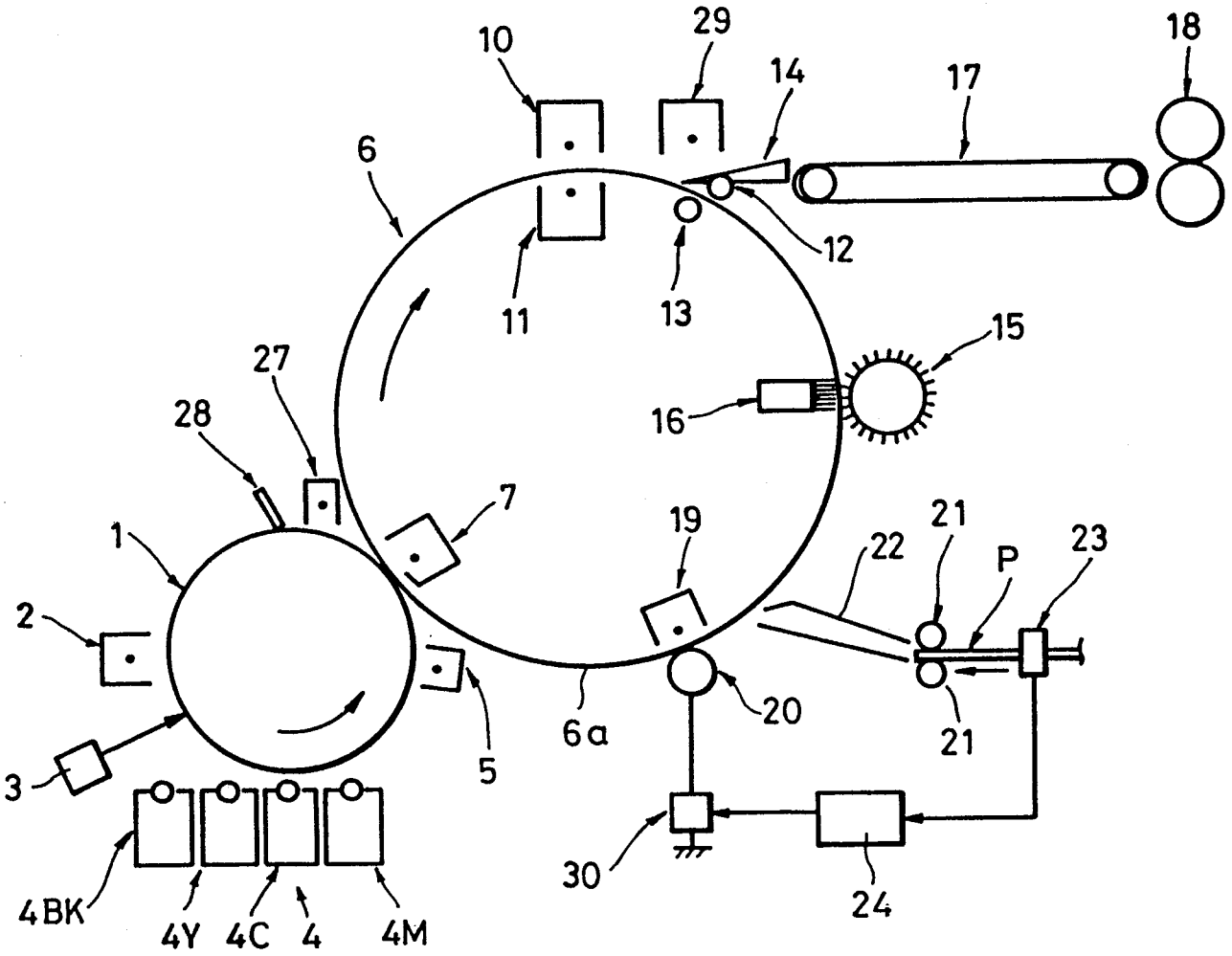
FIG. 4 is a schematic diagram showing another embodiment of the image forming apparatus of the present invention.

In an embodiment shown in FIG. 4, a control signal from the central processing unit 24 is supplied to a biasing power supply 30 for supplying the voltage applied to the conductive roller 20. To the biasing power supply 30, a DC voltage having a polarity opposite to that of the voltage applied to the corona charger 19 for adsorption or a voltage consisting of an AC voltage superposed to the DC voltage may be applied. The voltage applied to the conductive roller 20 is thereby changed.

Figure 5:
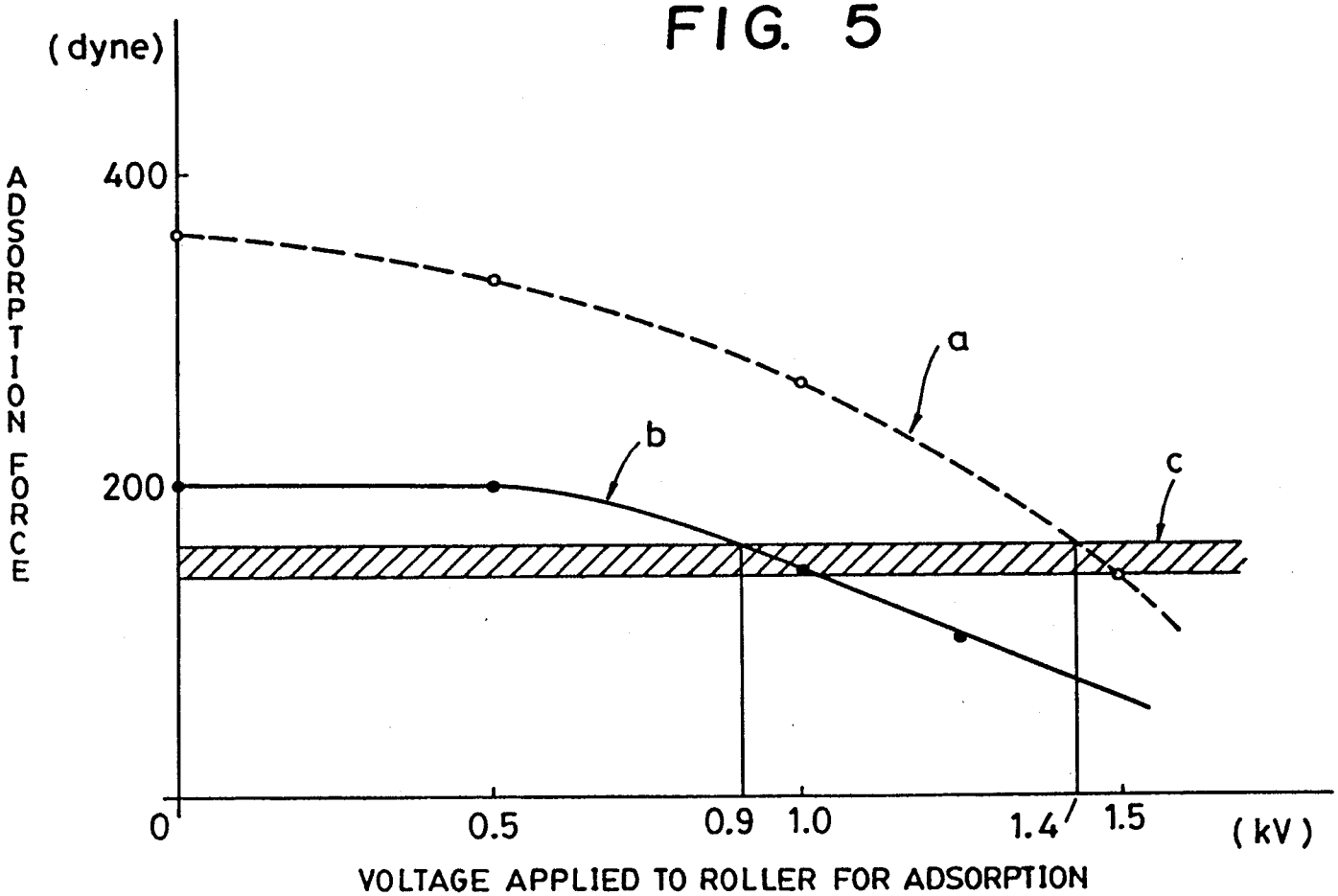
FIG. 5 is a graph showing a relationship between the voltage applied to a conductive roller for adsorption and the adsorption force.

FIG. 5 is a graph showing changes in the adsorption force of the transfer material P relative to the carrying sheet 6a when the voltage applied to the conductive roller 20 is changed. In this case, the charging current values for the corona charger 7 and 19 are both set to 200 μA. Other conditions of measurement are identical to those for the case of FIG. 2. The results show that the adsorption force decreases for both the sheet "a" for OHP (the dotted line) and ordinary paper "b" (the full line) as the applied voltage is increased.

Figure 6:
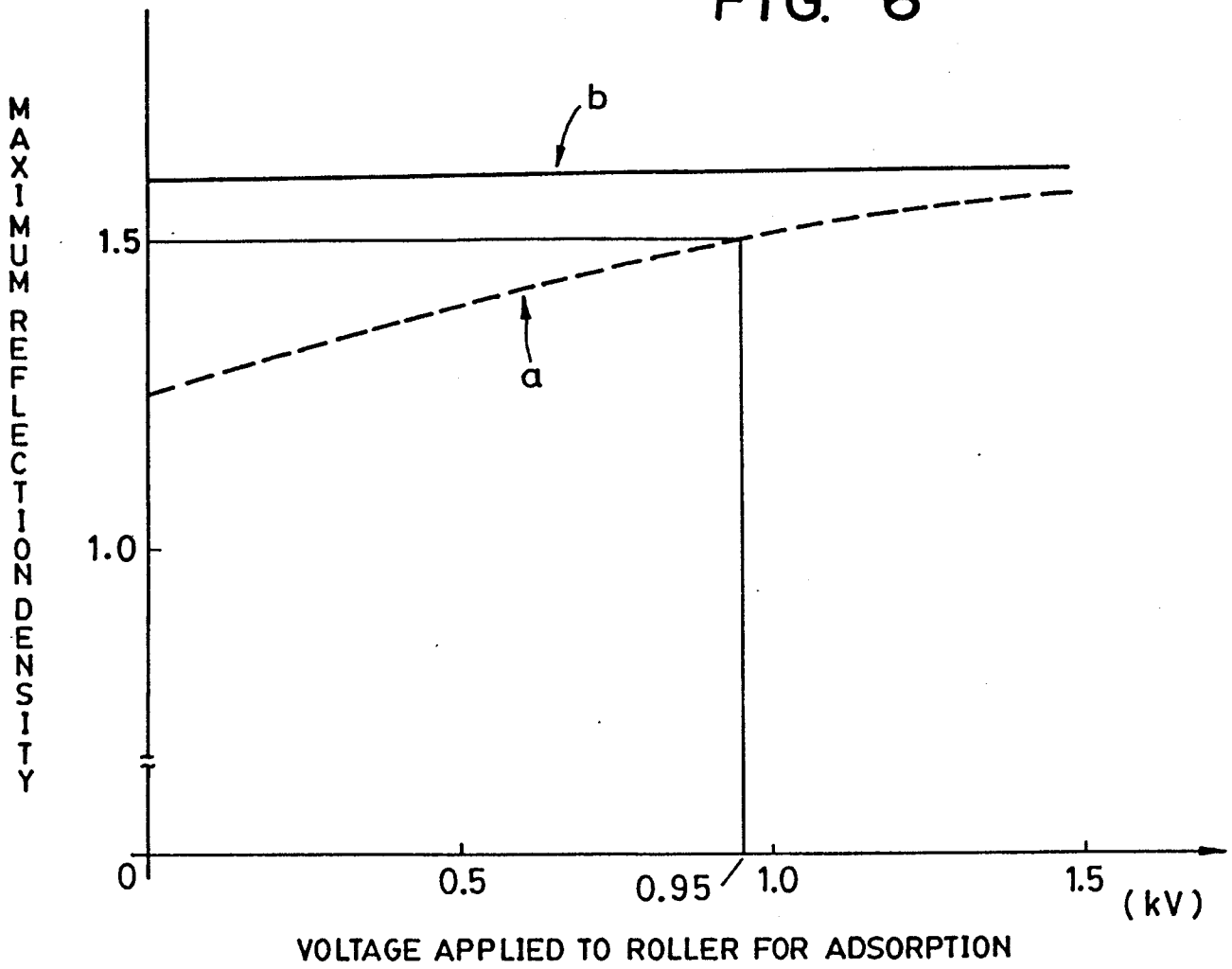
FIG. 6 is a graph showing a relationship between the above-described applied voltage and the maximum reflection density.

FIG. 6 shows changes in the maximum reflection density, that is, transfer efficiency when the voltage applied to the conductive roller 20 is changed, for the sheet "a" for OHP (the dotted line) and ordinary paper "b" (the full line).

From these results of measurement, judging form the hatched region (the practical threshold region where the transfer material P does not deviate from the carrying sheet 6a) C, the applied voltage must be 1.4 kV or less for the sheet "a" for OHP and 0.9 kV or less for ordinary paper "b". Furthermore, from FIG. 6, in order that the maximum reflection density is at least 1.5, the applied voltage must be 0.95 kV or more for the sheet "a" for OHP, with no practical lower limit for ordinary paper "b".

Accordingly, the condition in which both adsorption and transfer can be excellently performed is that the applied voltage is between 0.95 kV and 1.4 kV, inclusive, for the sheet of OHP and 0.9 kV or less for ordinary paper. It is considered that this is because, as the potential of the conductive roller 20 changes, the amount of the current of the corona charger 19 for adsorption toward the direction of the carrying sheet 6a changes, and the injected amount of electric charges relative to the transfer material P changes.

Consequently, in the present embodiment, the voltage may be set to, for example, 1.2 kV and 0.5 kV for the sheet of OHP and ordinary paper, respectively.

Figure 7:
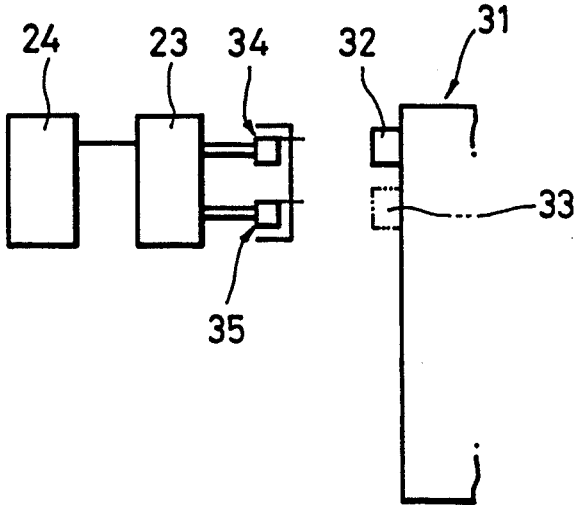
FIG. 7 is a plan view showing an embodiment of detection means for identifying the kind of a transfer material.

In an embodiment shown in FIG. 7, there is shown a configuration wherein a dedicated cassette 31, which is removable relative to the image forming apparatus, is provided for each transfer material P as the detection means 23 and the cassette 31 is electrically detected. In FIG. 7, when cassette 31 houses, for example, sheets for OHP or sheets for secondary translucent paper, the cassette 31 includes a driving piece 32. When the cassette 31 houses, for example, ordinary paper, it includes driving piece 33 (shown by the two-dot chain line). Switches 34 and 35, which are driven by the driving pieces 32 and 33 when the cassette 31 is set to the apparatus, are disposed at a cassette housing unit of the main body of the apparatus. Consequently, when the cassette 31 housing sheets of OHP or sheets for secondary translucent paper is set, the driving piece 32 operates the switch 34 to supply the central processing unit 24 with the corresponding signal from the detection means 23. On the other hand, when the cassette 31 housing ordinary paper is set, the driving piece 33 operates the switch 35 to supply the central processing unit 24 with the corresponding signal from the detection means 23.

In the above-described embodiment, the central processing unit 24 may be replaced by other appropriate control means. Furthermore, although the corona charger 19 (which does not need an escape mechanism of a connection plate linked to a ring of the transfer drum 6) or the conductive roller 20 for adsorption is used as the charge supply means, a conductive roller may be used in place of the corona charger 19 and voltage may be applied thereto.

Figure 9:
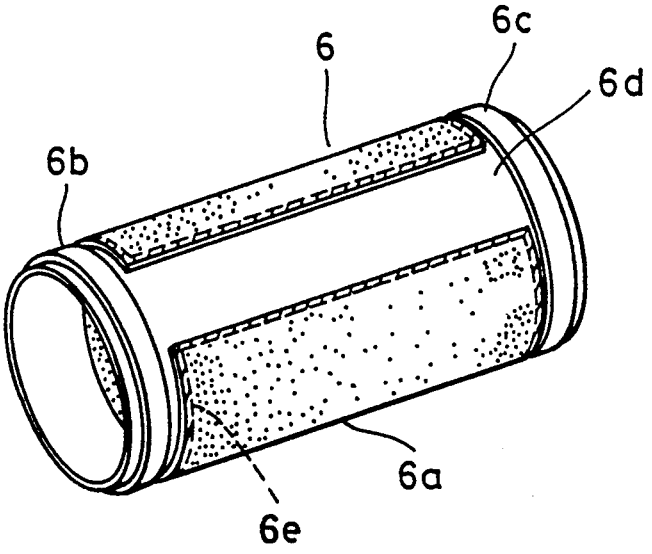
FIG. 9 is a perspective view showing an embodiment of a transfer drum.

As the transfer drum 6, a drum comprising an endless sheet on which the transfer material P can be adsorbed at an arbitrary position may be used. However, as shown in FIG. 9, it is preferred to use a drum which includes cylindrical rings 6b and 6c at both ends thereof in its longer direction and a connecting member 6d for connecting the rings, and on which the dielectric carrying sheet 6a is wound and carried in a portion 6e cut away on the surface of the frame of the drum, because the strength of the transfer drum 6 increases and the carrying sheet 6a is hardly deformed. In the case of using the transfer drum 6 as shown in FIG. 9, the use of the corona charger 19 for adsorption as described above is preferred to the use of a conductive roller in place of the corona charger 19 for adsorption. The reason is as follows. If a conductive roller is used for the transfer drum 6 as shown in FIG. 9, the transfer drum 6 produces a deviation in rotation when the conductive roller runs over the connecting member 6d by the rotation of the transfer drum 6, and a deviation in image is thereby produced. Accordingly, when the conductive roller is used within the transfer drum, it is necessary to provide a mechanism for separating the conductive roller from the connecting member 6d when it passes through the connecting member 6d. If the corona charger 19 for adsorption is used, however, such a separation mechanism becomes entirely unnecessary, and hence the configuration becomes simpler.

In place of the conductive roller, other appropriate conductive member may be used, or a corona discharger may also be used. Furthermore, in place of the above-described biasing power supply 30, other appropriate voltage application means may be used.

Although the above-described embodiments use a method in which the toner image once formed on the photosensitive drum in transferred on the transfer material as the image supporting member, the present invention may also be applied to a method in which an ink-jet-type recording head is faced on an endless belt as carrying means for an image supporting member and recording is performed on the image supporting member electrostatically adsorbed on the belt by the recording head.

Furthermore, the present invention is not limited to a method in which the transfer material as the image supporting member is electrostatically adsorbed on the transfer drum, but an opening (or a plurality of pin-hole openings) may be provided in a portion where the transfer material is carried on the transfer drum, and the transfer material may be adsorbed and carried on the transfer drum by sucking air through the openings from within the transfer drum. In this case, the vacuum amount for adsorption is controlled in place of the above-described charged amount for adsorption.

As explained above, according to the image forming apparatus of the present invention, it becomes possible to excellently adsorb the image support member relative to the carrying means, and an excellent image formation can be provided.

What is claimed is:

1. An image forming apparatus comprising:

a movable image carrying member;

image forming means for forming an image on said image carrying member;

transfer means for transferring said image on the image carrying member formed by said image forming means to an image supporting member at a transfer position;

carrying means for carrying said image supporting member and for conveying said image supporting member to said transfer position in order to perform said transfer;

adsorption means for causing said image supporting member to be electrostatically adsorbed onto said carrying means by supplying said image supporting member with electric charges, said adsorption means first carrying said image supporting member to said carrying means;

detection means for detecting a kind of image supporting member to be adsorbed; and control means for controlling an electric-charge supply amount by said adsorption means according to the kind of image supporting member detected by said detection means.

2. An image forming apparatus according to claim 1, wherein said adsorption means comprises a first electrode provided a first side where said carrying means carries said image supporting member and a second electrode provided at a side opposite to said first side.

3. An image forming apparatus according to claim 2, wherein said first electrode comprises a roller contacting said carrying means and wherein said second electrode comprises corona charging means.

4. An image forming apparatus according to claim 3, wherein said roller comprises a grounded conductive roller.

5. An image forming apparatus according to claim 3, wherein a voltage having a polarity component opposite to a voltage applied to said corona charging means is applied to said roller.

6. An image forming apparatus according to claim 3, wherein said control means controls a voltage applied to said corona charging means.

7. An image forming apparatus according to claim 5, wherein said control means controls the voltage applied to said roller.

8. An image forming apparatus according to claim 3, wherein said carrying means comprises rings provided at both end portions thereof in its longer direction, a connecting member for connecting said rings, and a sheet member provided in a cut-away portion of said carrying means.

9. An image forming apparatus according to claim 2, wherein a voltage applied to said second electrode has a polarity identical to a polarity of a voltage applied to said transfer means.

10. An image forming apparatus according to claim 1, wherein said carrying means comprises a sheet member for carrying the image supporting member, and wherein said sheet member comprises a dielectric sheet.

11. An image forming apparatus according to claim 1, wherein said detection means detects the optical transmittance or optical reflectivity of said image supporting member.

12. An image forming apparatus comprising:

image forming means for forming an image on an image supporting member at an image forming position;

movable carrying means or carrying said image supporting member and for conveying said image supporting member to said image forming position in order to perform said image formation;

adsorption means for causing said image supporting member to be adsorbed onto said carrying means, provided at a more upstream side than said image forming position in the direction of movement of said carrying means;

detection means for detecting a kind of said image supporting member; and control means for controlling adsorption force between said image supporting member and said carrying means by said adsorption means according to the kind of image supporting member detected by said detection means.

13. An image forming apparatus according to claim 12, wherein said adsorption means electrostatically adsorbs said image supporting member onto said carrying means by supplying said image supporting member with electric charges, and wherein said control means controls an electric-charge supply amount by said adsorption means.

14. An image forming apparatus according to claim 13, wherein said adsorption means comprises a first electrode provided at a first side where said carrying means carries said image supporting member and a second electrode provided at a side opposite to said first side.

15. An image forming apparatus according to claim 14, wherein said first electrode comprises a roller contacting said carrying means and wherein said second electrode comprises corona charging means.

16. An image forming apparatus according to claim 15, wherein said roller comprises a grounded conductive roller.

17. An image forming apparatus according to claim 15, wherein a voltage having a polarity component opposite to a voltage applied to said corona charging means is applied to said roller.

18. An image forming apparatus according to claim 17, wherein said control means controls the voltage applied to said roller.

19. An image forming apparatus according to claim 15, wherein said control means controls the voltage applied to said corona charging means.

20. An image forming apparatus according to claim 13, wherein said carrying means comprises a sheet member for carrying the image supporting member, and wherein said sheet member comprising a dielectric sheet.

21. An image forming apparatus according to claim 12, wherein said detection means detects the optical transmittance or optical reflectivity of said image supporting member.

22. An image forming apparatus comprising:

a movable image carrying member;

image forming means for forming an image on said image carrying member;

transfer means for transferring said image on the image carrying member formed by said image forming means to an image supporting member at a transfer position;

carrying means for carrying said image supporting member and for conveying said image supporting member to said transfer position in order to perform said transfer, said carrying means comprises a sheet member for carrying the image supporting member, said sheet member comprising a dielectric sheet;

adsorption means for causing said image supporting member to be electrostatically adsorbed onto said carrying means by supplying said image supporting member with electric charges, said adsorption means first carrying said images supporting member to said carrying means;

detection means for detecting the relative dielectric constant of said image supporting member; and control means for controlling an electric-charge supply amount by said adsorption means according to the relative dielectric constant detected by said detection means.

23. An image forming apparatus according to claim 22, wherein said adsorption means comprises a first electrode provided at a first side where said carrying means carries said image supporting member and a second electrode provided at a side opposite to said first side.

24. An image forming apparatus according to claim 23, wherein said first electrode comprises a roller contacting said carrying means and wherein said second electrode comprises corona charging means.

25. An image forming apparatus according to claim 24, wherein said roller comprises a grounded conductive roller.

26. An image forming apparatus according to claim 24, wherein a voltage having a polarity component opposite to a voltage applied to said corona charging means is applied to said roller.

27. An image forming apparatus according to claim 26, wherein said control means controls the voltage applied to said roller.

28. An image forming apparatus according to claim 24, wherein said control means controls the voltage applied to said corona charging means.

29. An image forming apparatus according to claim 23, wherein a voltage applied to said second electrode has a polarity identical to a polarity of a voltage applied to said transfer means.

30. An image forming apparatus according to claim 24, wherein said carrying means comprises rings provided at both end portions thereof in it longer direction, a connecting member for connecting said rings, and a sheet member provided in a cut-away portion of said carrying means.

31. An image forming apparatus according to claim 22, wherein said carrying means comprises a sheet member for carrying the image supporting member, and wherein said sheet member comprises a dielectric sheet.

32. An image forming apparatus according to claim 12, or 22, wherein said transfer means transfers a plurality of toner images to the same image supporting member.

33. An image forming apparatus according to claim 32, wherein said toner images comprises color toner images.

34. An image forming apparatus according to claim 1, 12 or 22, wherein said carrying means carries said image supporting member only by electrostatic power.

35. An image forming apparatus according to claim 1 or 22, wherein said adsorption means is provided upstream said transfer position in relation to the direction of movement of said carrying means.

36. A image forming apparatus according to claim 1, 11, 12, 21 or 22, wherein said detection means detects whether said image supporting member is a paper or a transparent sheet.

37. An image forming apparatus according to claim 1, 12 or 22, wherein said detection means detects said supporting member type before said image supporting member is adsorbed on said carrying means by said adsorption means.

38. An image forming apparatus comprising:

a movable image carrying member;

image forming means for forming an image on said image carrying member;

transfer means for transferring an image on the image carrying member formed by said image forming means to an image supporting member at a transfer position;

carrying means for carrying said image supporting member and for conveying said image supporting member to said transfer position in order to perform said transfer;

adsorption means for causing said image supporting member to be adsorbed onto said carrying means, said adsorption means carrying said image supporting member to said carrying means at first;

control means for controlling adsorption force between said image supporting member and said carrying means by said adsorption means according to the kind of image supporting member.

* * * * *

UNITED STATES PATENT AND TRADEMARK OFFICE

CERTIFICATE OF CORRECTION

PATENT NO. : 5,019,871

DATED : May 28, 1991

INVENTOR(S) : ATSUSHI TAKEDA ET AL.

It is certified that error appears in the above-identified patent and that said Letters Patent is hereby corrected as shown below:

ON THE COVER PAGE

At [56] References Cited, in the third reference, "Doj" should read --Doi--.

COLUMN 1

Line 54, "image," should read --image--.

COLUMN 3

Line 49, "rottatably" should read --rotatably--.

COLUMN 4

Line 14, "tansfer drum 6" should read --transfer drum 6--.
Line 28 should be deleted.
Line 29, "sheet 6a," should be deleted.

UNITED STATES PATENT AND TRADEMARK OFFICE

CERTIFICATE OF CORRECTION

PATENT NO. : 5,019,871

DATED : May 28, 1991

INVENTOR(S) : ATSUSHI TAKEDA ET AL.

It is certified that error appears in the above-identified patent and that said Letters Patent is hereby corrected as shown below:

Column 5

Line 32, "resist rollers 21, 22" should read --resist rollers 21, 21--.

COLUMN 6

Line 2, "tranfer" should read --transfer--.
Line 7, "charges 10 and 11" should read --chargers 10 and 11--.
Line 39, "abtained" should read --obtained--.
Line 44, "is magenta," should read --is, magenta,--.

COLUMN 8

Line 15, "points )" should read --points O)--.
Line 16, "points )" should read --points ●)--.

COLUMN 10

Line 24, "includes" should read --includes a--.

IN THE CLAIMS

COLUMN 11

Line 66, "provided a" should read --provided at a--.

UNITED STATES PATENT AND TRADEMARK OFFICE

CERTIFICATE OF CORRECTION

PATENT NO. : 5,019,871

DATED : May 28, 1991

INVENTOR(S) : ATSUSHI TAKEDA ET AL.

It is certified that error appears in the above-identified patent and that said Letters Patent is hereby corrected as shown below:

COLUMN 12

Line 40, "or" should read --for--.

COLUMN 13

Line 21, "comprising" should read --comprises--.
Line 39, "comprises" should read --comprising--.
Line 47, "images" should read --image--.

COLUMN 14

Line 17, "it" should read --its--.
Line 26, "12, or 22," should read --1, 12 or 22,--.
Line 30, "comprises" should read --comprise--.
Line 39, "A" should read --An--.

Signed and Sealed this

Twenty-sixth Day of January, 1993

*Attest:*

STEPHEN G. KUNIN

*Attesting Officer*

*Acting Commissioner of Patents and Trademarks*